United States Patent [19]

Lovis

[11] 4,178,397

[45] Dec. 11, 1979

[54] METHOD AND APPARATUS FOR TREATING ONE SIDE OF A STRIP

[75] Inventor: John B. Lovis, Allentown, Pa.

[73] Assignee: Bethlehem Steel Corporation, Bethlehem, Pa.

[21] Appl. No.: 924,113

[22] Filed: Jul. 12, 1978

[51] Int. Cl.[2] ..... C23C 1/02

[52] U.S. Cl. ..... 427/300; 427/282; 427/434 B; 118/62; 118/68; 118/419; 118/406

[58] Field of Search ..... 427/300, 434 B, 282; 118/406, 419, 68, 62

[56] References Cited

U.S. PATENT DOCUMENTS

| | | | |
|---|---|---|---|
| 1,252,363 | 1/1918 | Roberts | 427/300 X |
| 3,197,339 | 7/1965 | Black et al. | 134/15 |
| 3,313,462 | 4/1967 | Smith | 236/97 |
| 3,395,034 | 7/1968 | Przybilla | 118/419 X |
| 3,649,381 | 3/1972 | Mayhew | 148/156 |
| 3,688,738 | 9/1972 | Eichler et al. | 118/419 X |
| 4,082,868 | 4/1978 | Schnedler et al. | 427/432 X |
| 4,103,644 | 8/1978 | Michels | 118/63 |

*Primary Examiner*—Ralph S. Kendall

*Attorney, Agent, or Firm*—Joseph J. O'Keefe; Michael J. Delaney

[57] ABSTRACT

A method and apparatus for treating only one side of a strip of material utilizes a pressurized foil bearing. The strip passes around the foil bearing while contacting a bath of liquid material. By controlling the pressure of the pressurizing medium used within the foil bearing, the strip is supported on a film of the pressurizing medium and the liquid material is prevented from contacting the side of the strip adjacent the foil bearing while the other side of the strip is in contact with the liquid material. Preferably, the pressurizing medium is at about the same temperature as the liquid material. Furthermore, a non-oxidizing gas may be used as the pressurizing medium to protect the side of the strip adjacent the foil bearing from oxidizing.

11 Claims, 4 Drawing Figures

METHOD AND APPARATUS FOR TREATING ONE SIDE OF A STRIP

BACKGROUND OF THE INVENTION

There is growing demand for a method and apparatus for treating only one side of a strip product. For example, manufacturers are seeking a strip product wherein one side is corrosion resistant and the other side is such that a good paint finish may be applied thereto. One example of such a product is a steel strip coated on only one side with zinc for corrosion resistance while the other side of the strip may be painted.

A number of methods to produce a one sided, zinc coated steel strip have been proposed. Such methods include (1) applying a material to the strip which prevents one side of the strip from accepting the zinc, (2) coating both sides of the strip and thereafter removing the coating from one side, (3) utilizing vacuum deposition or electrolytic coating to apply a coating to one side of the strip, and (4) welding two strips of steel together, passing the double thickness through a coating step and thereafter separating the two strips.

All of the above proposed methods have one or more of the following disadvantages: high operating costs, significant investment in new equipment or substantial departure from existing two side coating operations.

SUMMARY OF THE INVENTION

It is an object of this invention to provide an efficient and economical method and apparatus for treating one side of a strip.

It is another object of this invention to provide a method and apparatus which can be readily adapted for use with existing two side treating operations.

The above objects can be accomplished by providing a method and apparatus for treating, e.g. coating, only one side of a strip comprising a pressurized foil bearing, passing a strip immediately adjacent the foil bearing and into contact with a bath of coating material, and controlling the pressure of the pressurizing medium used within said foil bearing so as to support the strip on a film of the pressurizing medium and out of contact with the foil bearing and to prevent the coating material from contacting the side of the strip adjacent the foil bearing by the flow of the pressurizing medium while the other side of the strip is coated with the coating material.

DETAILED DESCRIPTION OF THE DRAWINGS

Figure 1:
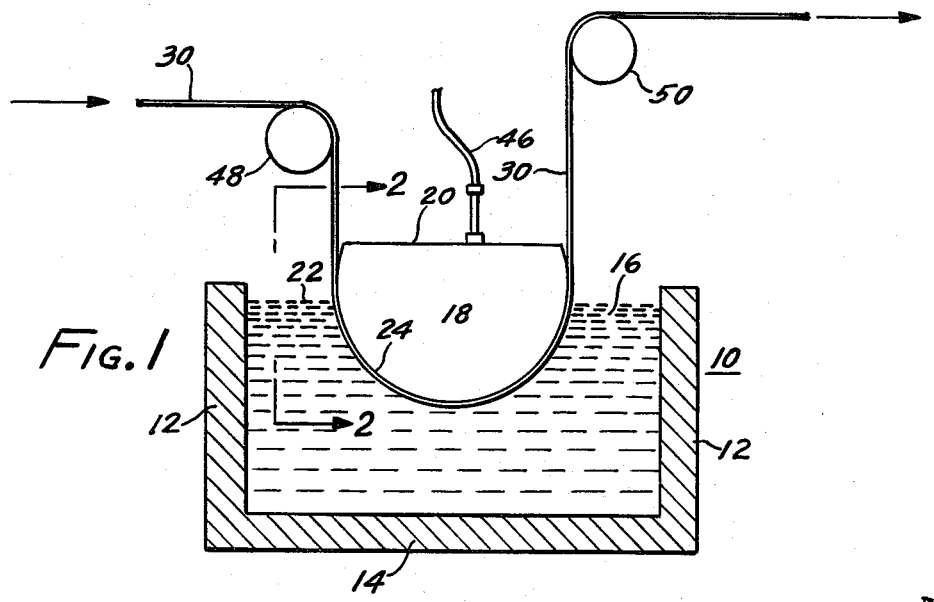
FIG. 1 is a side view, partly in section, of this invention.

Referring to FIG. 1, a receptacle 10 having walls 12 and bottom 14 contains a bath of a liquid material 16. If necessary, heating means (not shown) may be used to provide heat to the liquid material 16. Mounted above and extending into the liquid material 16 is a foil bearing 18. The foil bearing 18 includes a substantially flat upper surface 20 and a lower curved surface 24. The depth that the foil bearing 18 extends into the liquid material

16 may be varied considerably. For example, if it is desired to increase the residence time of the strip 30 in the bath of liquid material 16, the depth that the foil bearing 18 extends into the bath may be increased. Likewise, if it is desired to decrease the residence time of the strip 30 in the bath of liquid material 16, the depth the foil bearing 18 extends into the bath may be decreased. Furthermore, the foil bearing may be positioned such that the strip 30 just touches the upper surface 22 of the bath of liquid material 16.

Figure 2:
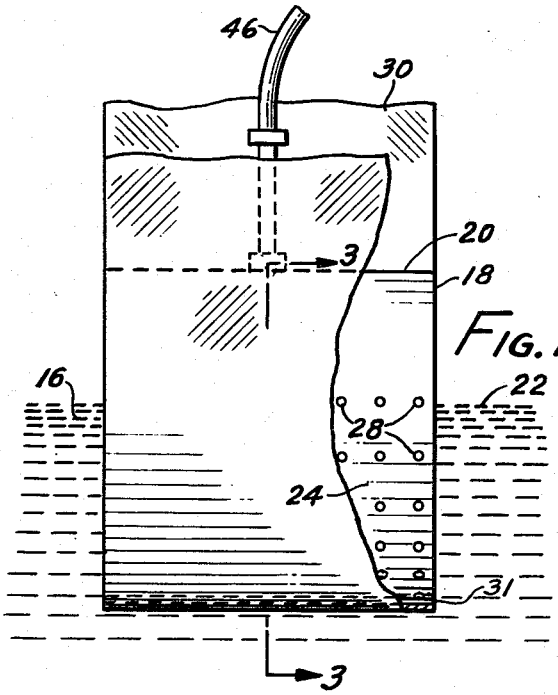
FIG. 2 is a view taken along the line 2—2 of FIG. 1 with parts removed for clarity.
Figure 3:
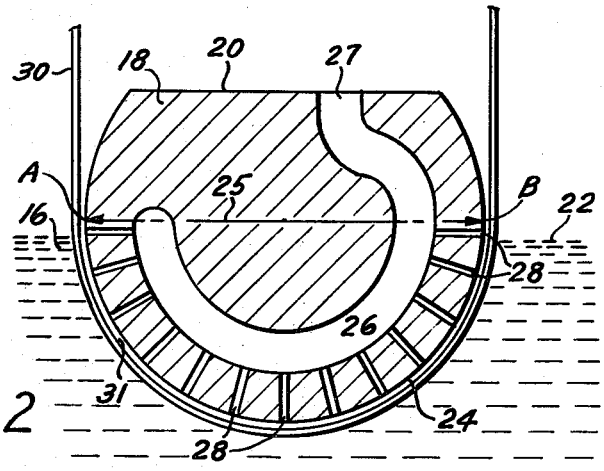
FIG. 3 is a view taken along the line 3—3 of FIG. 2 with parts removed for clarity.

Referring to FIG. 3, the foil bearing 18 has a diameter 25 and includes an interior pressure chamber 26 having an inlet 27. Orifices 28 extend through the curved surface 24 into the pressure chamber 26. As shown in FIGS. 2 and 3, the orifices 28 are substantially uniformly distributed over the curved surface 24 of the foil bearing 18. The size, number and distribution of the orifices 28 over the curved surface 24 depends in part on the diameter 25 of the foil bearing 18, width of strip 30 to be treated, the tension in the strip 30 and the thickness of the film 31 of pressurizing medium between the foil bearing 18 and strip 30 and the pressure of the film 31 to be achieved.

The manner of designing a foil bearing is well known to persons skilled in the art. Furthermore, a porous material may be used to form a foil bearing, in which case the pores of the material act as orifices.

Figure 4:
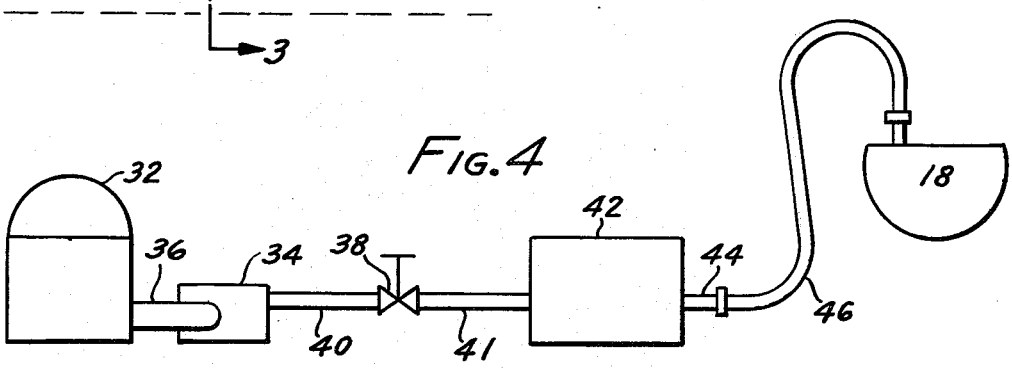
FIG. 4 is a block diagram showing apparatus to supply a gaseous medium to the foil bearing.

A pressurizing medium is supplied to the interior pressure chamber 26 of the foil bearing 18 by means of the arrangement shown in FIG. 4. The number 32 indicates a supply of pressurizing medium which is supplied to a compressor 34 by means of pipe 36. The discharge pressure of the compressor 34 is controlled by a regulating valve 38 in compressor discharge line 40. After passing through the regulating valve 38, the pressurizing medium enters line 41 and may be heated, if necessary, by heating means. From heating means 42, the pressurizing medium if fed through line 44 and flexible hose 46 to the interior pressure chamber of foil bearing 18.

In operation and as shown in FIG. 1 the arrangement used to pass strip 30 into and out of the bath of liquid material 16 in receptable 10 is as follows. On the inlet side of the bath, the strip 30 passes over entrance roll 48, then into the bath and around curved surface 24 of foil bearing 18. On the outlet side of the bath the strip 30 passes from the foil bearing 18, out of the bath and over exit roll 50. In so moving the strip 30, the pressurizing medium is at a sufficient pressure and flow such that the strip 30 is supported on the curved bearing surface 24 by a thin film 31 of pressurizing medium and, in addition, the pressurizing medium sets up a curtain such that the liquid material 16 does not contact the side of the strip 30 adjacent the curved surface 24. Furthermore, as best shown in FIG. 3, the tangent points A and B assumed by the strip 30 relative the foil bearing 18 when pressurizing medium is not supplied to the foil bearing 18 should be located above the surface 22 of the bath to ensure that the liquid material 16 does not contact the side of the strip 30 adjacent the curved surface 24.

The pressurizing medium should be selected in view of the type treatment to be applied to the strip. For some treatments such as, for example, pickling and cleaning, the pressurizing medium may be air. For other treatments, the pressurizing medium may be an inert or reducing gas. For still other treatments the pressurizing medium may be some other gas and/or a liquid. As noted above, the pressurizing medium may be heated if the particular treatment and liquid material require heating.

The treatments that may be practiced by this invention include, for example, coating, hot dip coating, curing, etching, pickling, impregnation, and cleaning. Thus the liquid material may be selected to practice such treatments.

The strip 30 may be made of numerous materials including, for example, paper, plastic, rubber, metal, and alloys of metals.

The above enumeration of specific examples of pressurizing medium, types of treatment, and strip materials is by way of example only and not by way of limitation to this invention. In addition, the word strip should be broadly construed to cover various widths, thicknesses and lengths of material consistent with the operation of this invention, Briefly, the pressure and flow of the pressurizing medium applicable to this invention is dependent on a number of variables including the viscosity of the pressurizing medium, the density of the liquid material in the bath, strip tension, bearing area between the strip and the foil bearing, and the force of the liquid material in the bath tending to enter the area between the strip and the foil bearing.

SPECIFIC EXAMPLES

A strip 31" wide and 72" long was tensioned to about 1½ to 3 pounds and passed at a speed of 1–3 feet per minute over a foil bearing 4½" in diameter and 3½" wide. The thickness of the air film between the foil bearing and the strip was about 0.001". The strip had a 180° angle of wrap around the foil bearing. The foil bearing included 90 orifices having a diameter of 1/16" and located on ½" centers. The foil bearing was connected to an air supply which could be heated as required. The pressure of the air supply in line 41, i.e., after the reducing valve 38 and before the heating means 42, was about 1 psi. A receptacle with a heating device was located below the foil bearing and could be raised to submerge the strip and foil bearing to a depth of about 1" to 1½" below the surface of the coating liquid within the pot.

The following Table 1 shows the strip material, strip dimensions, coating material, bath temperature, pressurizing medium temperature and strip speed used in coating one side of the strip.

Table I

| Test No. | Strip Material | Width and Thickness of Strip Material | Coating Material | Temperature of Coating Bath | Temperature of Pressurizing Medium | Strip Speed |
|---|---|---|---|---|---|---|
| 1 | Steel | 3" × .002" | Wood's Metal | 500° F. | 320° F. | 1–3 ft./min |
| 2 | Steel | 3" × .002" | Latex Paint | Ambient | Ambient | 3 ft./min. |
| 3 | Steel | 3" × .002" | Wax | 160° F. | Ambient | 3ft./min, |

In each of the above tests, the strip of material was coated on one side with coating material while the other side was not coated with the coating material.

It was found that this invention is capable of producing a product coated on one side with the liquid material in the bath while the other side remains uncoated.

It should be understood that other processing steps may be applied to the strip in addition to the various treatments which can be applied to the strip by this invention. Such other processing steps may be applied to the strip before and/or after the treatment of the strip in accordance with this invention. In addition, it should be understood that apparatus in addition to the apparatus of this invention may be used to accomplish such other processing. Furthermore, the foregoing description has been presented in furtherance of a comprehensive and complete description of this invention rather than for purposes of limitation of this invention.

I claim:

1. A method of treating strip on one side comprising:

(a) providing a pressurized foil bearing with a lower curved surface extending a distance into a bath of liquid material, (b) passing the strip into contact with the liquid material of said bath adjacent said foil bearing so that both sides of the strip are below the level of liquid material in said bath, and (c) controlling the pressure of the pressurizing medium used within said foil bearing so as to support said strip on said foil bearing by a thin film of said pressurizing medium and to establish a curtain of pressurizing medium to prevent said liquid material from passing between said curved surface and said strip and contacting the side of said strip adjacent said foil bearing while the other side of said strip is in contact with said liquid material.

2. The method of claim 1 wherein said pressurizing medium is a non-oxidizing gas.

3. The method of claim 1 wherein the pressurizing medium is at a temperature approximately equal to the temperature of said liquid material.

4. A method of coating strip on one side comprising (a) providing a pressurized foil bearing extending above and below the level of a bath of coating material, (b) passing the strip into and out of the bath with one side of the strip adjacent said foil bearing such that both sides of the strip extend below the level of coating material in the bath, (c) controlling the pressure of the pressurizing medium used within said foil bearing so as to support said strip on said foil bearing by a thin film of pressurizing medium and to establish a curtain of pressurizing medium to prevent said coating material from passing between said curved surface and said strip and contacting the side of said strip adjacent said foil bearing while the other side of said strip is in contact with said coating material.

5. The method of claim 4 wherein the pressurizing medium is a non-oxidizing gas.

6. The method of claim 5 wherein the pressurizing medium is at a temperature approximately equal to the temperature of the coating material.

7. The method of claim 6 wherein the strip is made of steel and the coating material is a metal.

8. The method of claim 7 wherein the coating material is zinc.

9. The method of claim 4
wherein the strip is made of steel and the coating material is a metal.

10. The method of claim 10
wherein the coating material is zinc.

11. Apparatus for treating one side of a strip comprising:

(a) a bath of liquid material, (b) a pressurized foil bearing having a lower curved surface extending into the bath of liquid material, (c) means to pass the strip below the level of liquid material in the bath and around the lower portion of the curved surface of the foil bearing, and (d) means to control the pressure of the pressurizing medium used within said foil bearing so as to prevent said liquid material from passing between the strip and the curved surface of the foil bearing and contacting the said of strip adjacent said foil bearing while the other side of said strip is heated with said liquid material.

* * * * *